US007618168B1

(12) United States Patent
Buse

(10) Patent No.: US 7,618,168 B1
(45) Date of Patent: Nov. 17, 2009

(54) SHATTER GLASS GUARD AND VENTING EFFECT DESIGN

(75) Inventor: John Jeffrey Buse, Mantachie, MS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 106 days.

(21) Appl. No.: 11/555,742

(22) Filed: Nov. 2, 2006

(51) Int. Cl.
*F21V 17/00* (2006.01)

(52) U.S. Cl. ..... 362/456; 362/455; 362/382; 362/300; 362/311; 362/344; 362/345; 362/264

(58) Field of Classification Search ..... None
See application file for complete search history.

(56) References Cited

U.S. PATENT DOCUMENTS

| | | | | | |
|---|---|---|---|---|---|
| 1,273,084 | A | | 7/1918 | Momb | |
| 1,637,786 | A | | 8/1927 | Rekar | |
| 1,697,216 | A | | 1/1929 | Welker | |
| 1,729,647 | A | * | 10/1929 | Clifford | 362/373 |
| 1,900,539 | A | | 3/1933 | Brady | |
| 2,016,474 | A | * | 10/1935 | Wood | 362/294 |
| 2,824,217 | A | * | 2/1958 | Karole | 362/294 |
| 3,156,416 | A | * | 11/1964 | Griffin | 362/549 |
| 3,461,283 | A | | 8/1969 | Hahn | |
| 4,504,888 | A | * | 3/1985 | Rosenthal | 362/18 |
| 4,516,196 | A | * | 5/1985 | Blake | 362/311 |
| 4,520,436 | A | * | 5/1985 | McNair et al. | 362/366 |
| 4,574,337 | A | * | 3/1986 | Poppenheimer | 362/267 |
| 4,959,762 | A | * | 9/1990 | Soileau | 362/376 |
| 5,373,431 | A | * | 12/1994 | Hayman et al. | 362/364 |
| 5,725,303 | A | * | 3/1998 | Lin | 362/376 |
| 5,997,160 | A | | 12/1999 | Swanson | |
| 6,116,759 | A | | 9/2000 | Smith | |
| 6,305,829 | B1 | | 10/2001 | Thomas et al. | |
| 6,350,046 | B1 | | 2/2002 | Lau | |
| 6,379,025 | B1 | * | 4/2002 | Mateescu et al. | 362/293 |
| 6,416,205 | B2 | | 7/2002 | Uedono | |
| 6,491,413 | B1 | * | 12/2002 | Benesohn | 362/294 |
| 6,905,233 | B1 | | 6/2005 | Blumenfeld-Kesler | |
| 2002/0008975 | A1 | | 1/2002 | Uedono et al. | |

* cited by examiner

*Primary Examiner*—Sandra L O'Shea
*Assistant Examiner*—Danielle Allen

(57) ABSTRACT

A shatter glass guard and venting effect design for a fixture of a luminaire adapted to provide adequate shatter guard protection for the purpose of preventing glass from a broken lamp from being released from the fixture. An annular ring of perforated material is attached to an open end of a reflector. A lens is attached to the outside surface of the annular ring and is dimensioned to expose a portion of the perforated material to allow for venting of heat from within the fixture. The lens and lamp can be installed or removed from the fixture after installation without access from the top of the light housing. The lens when mounted becomes integral with the reflector and moves with the reflector should the reflector need to be adjusted or tilted for aiming. The lens and annular ring combination provides adequate shatter guard protection and venting of the fixture.

21 Claims, 4 Drawing Sheets

SHATTER GLASS GUARD AND VENTING EFFECT DESIGN

TECHNICAL FIELD

The present invention relates to a luminaire shatter glass guard and particularly to a shatter glass guard with a venting effect.

DETAILED DESCRIPTION

Figure 1:
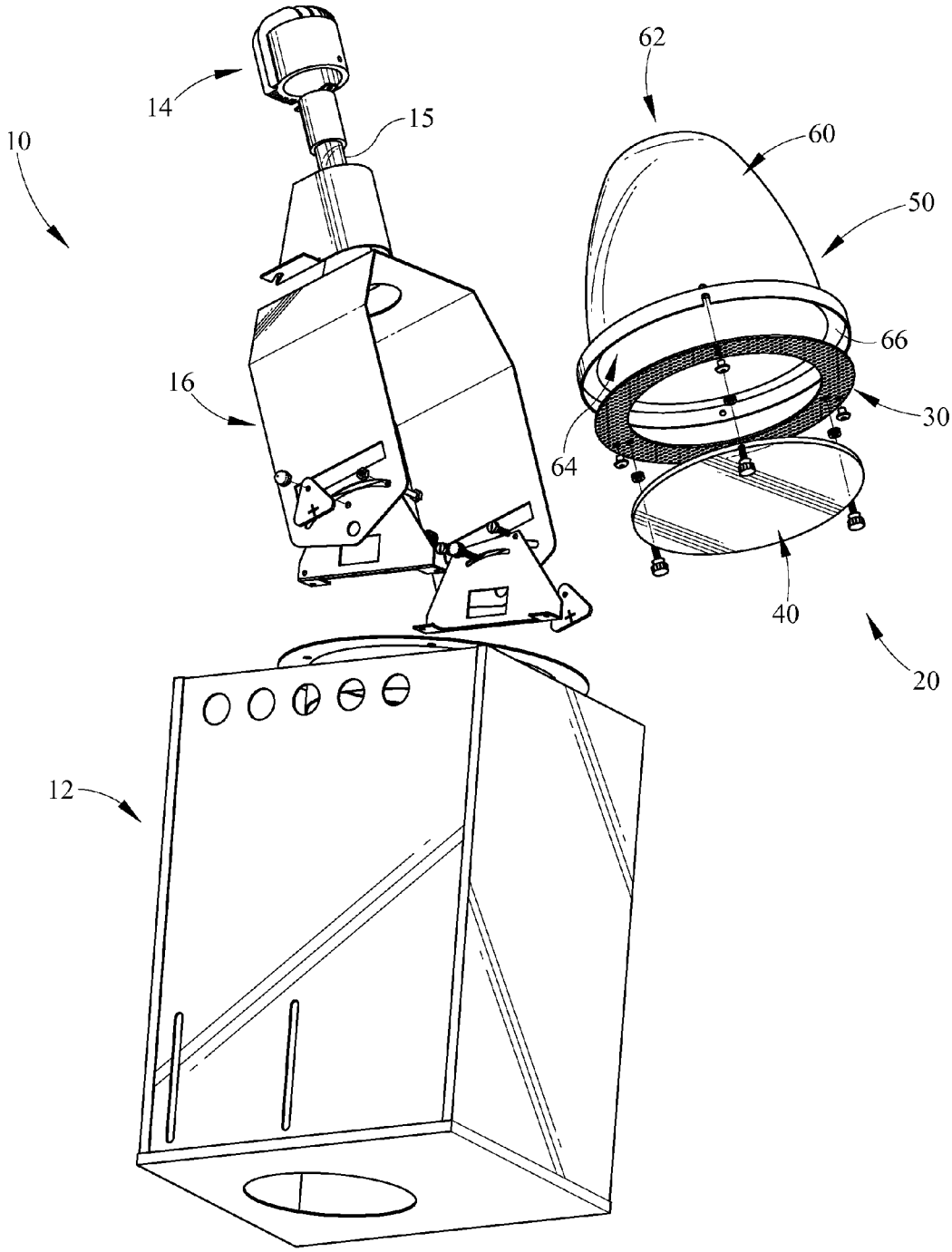
FIG. 1 is a bottom perspective view of a luminaire having a luminaire shatter glass guard with venting effect according to one embodiment.

A luminaire 10 having a shatter glass guard and venting effect design 20 depicted in the drawings allow for adequate shatter guard protection and venting of a lamp fixture 50. As shown in FIG. 1, shatter glass guard and venting effect design 20 is contained within fixture 50 which may be mounted in a luminaire housing 12 upon an adjustable mounting bracket 16.

Although luminaire housing 12, a lamp module 14, and mounting bracket 16 is shown in detail in FIG. 1, it is merely representative of luminaries in general, and it is to be understood that there are a variety of housings, lamp modules, and brackets that may be used in this embodiment.

Figure 2:
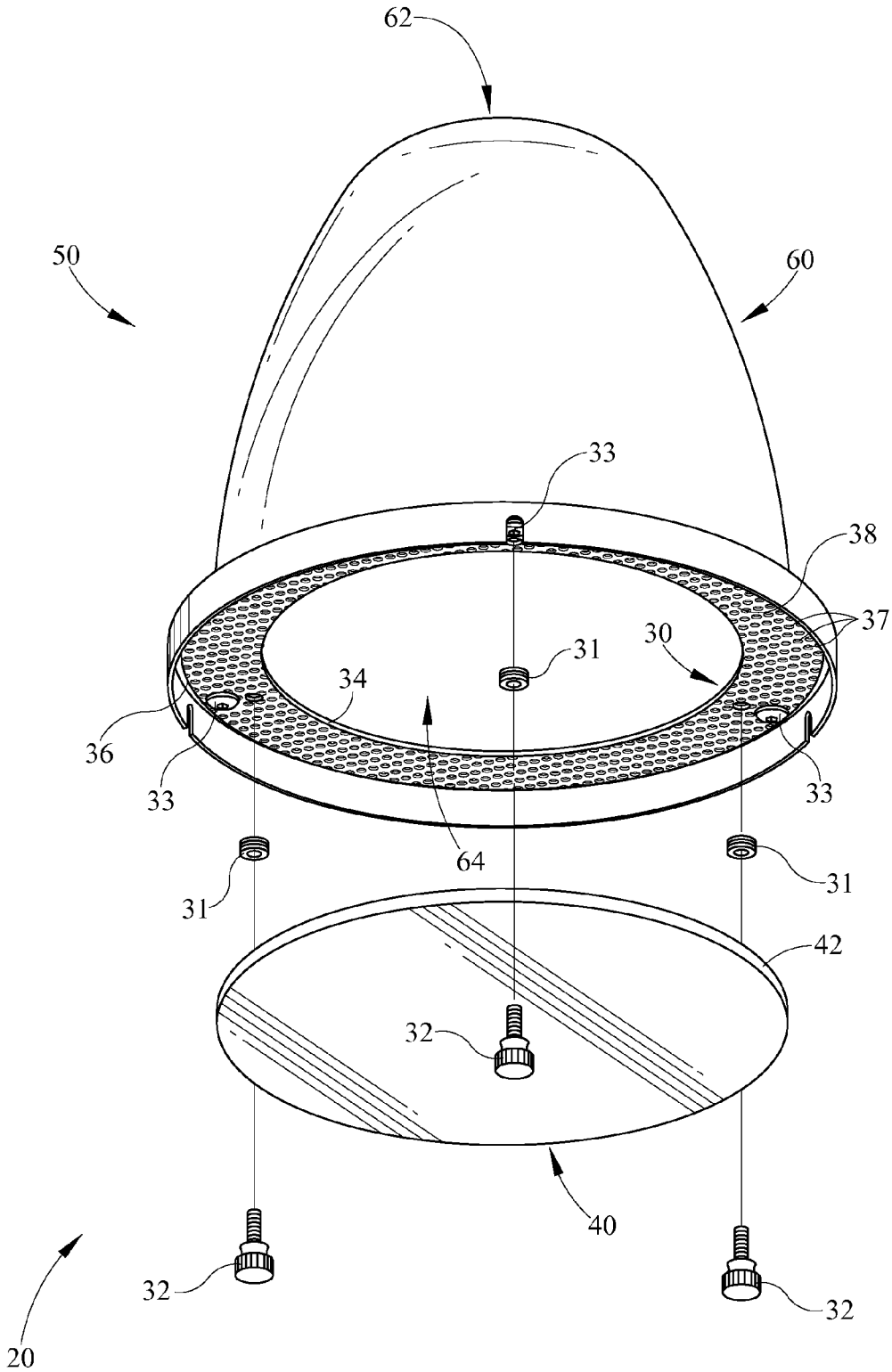
FIG. 2 is a bottom perspective view of the shatter glass guard with venting effect of FIG. 1.
Figure 3:
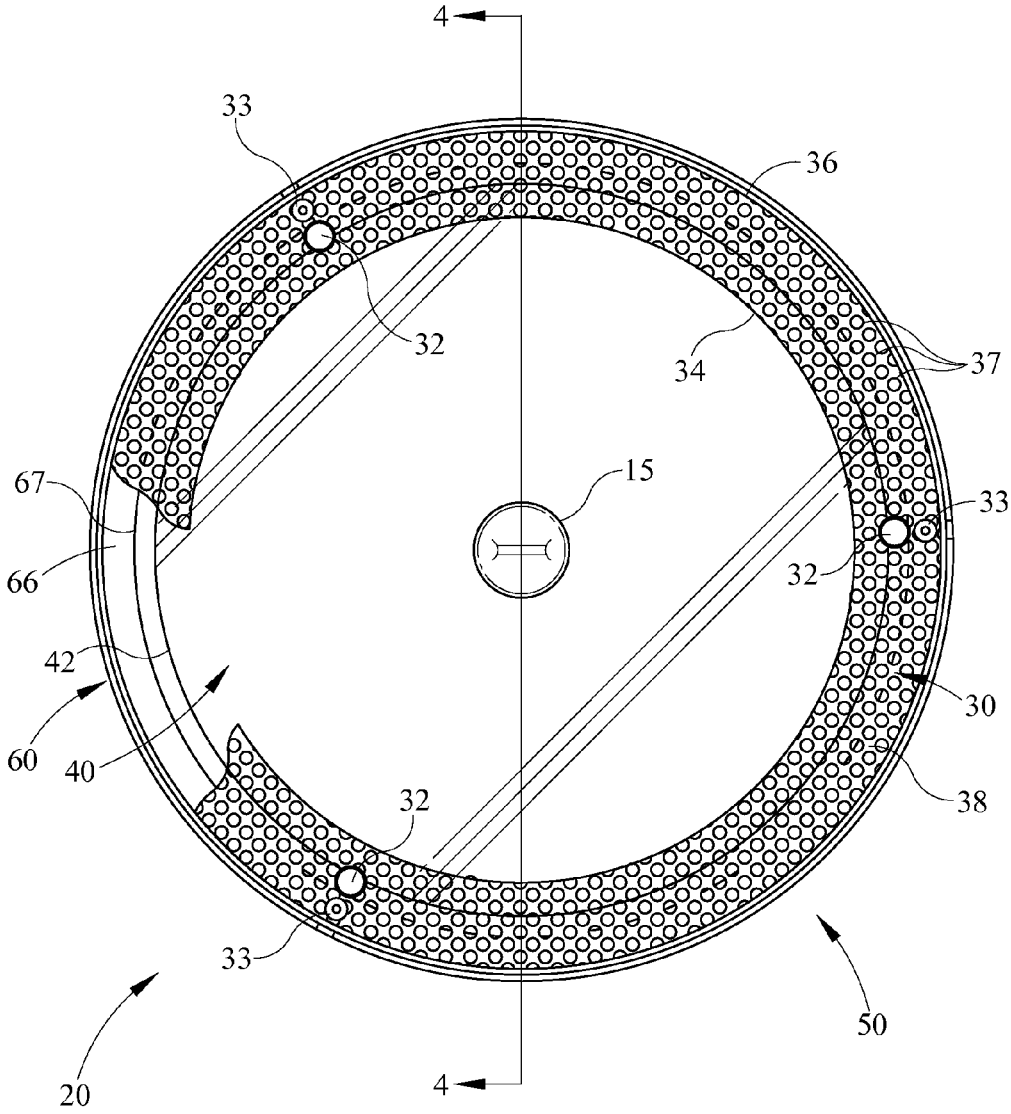
FIG. 3 is a bottom view of the shatter glass guard with venting effect having the annular ring partially broken away.

As shown in FIGS. 1-4, lamp fixture 50 contains a reflector 60, an annular ring 30, and a shatter guard lens 40. Reflector 60, typically having a reflective nature to the material, has a closed end 62 and an open end 64. Closed end 62, located at the top end of reflector 60, receives lamp module 14 and/or a lamp 15. Lamp 15 may be a high intensity discharge (HID) lamp wherein a shatter guard should be provided to insure that no glass is released from the fixture upon the potential breakage of lamp. End of life explosions of HID lamps, while not frequent, may occur. Open end 64, located at the bottom end of reflector 60, allows for the light generated by lamp 15 to be transmitted out of the fixture. As shown in FIGS. 1-4, reflector 60 may have a flange 66 in which annular ring 30 may be rest upon and secured. Annular ring 30 may have a removable or non-removable fastening arrangement to reflector 60 depending on its application. However, as shown in FIGS. 1-4, a plurality of rivets 33 attaches annular ring 30 to flange 66 of fixture 60. Annular ring 30 comprises of, but is not limited to, a perforated or expanded metal material. As shown in FIGS. 1-3, the perforations of annular ring may be a plurality of perforations 37 which are screen-like in appearance. Each perforation 37 is, but is not limited to, substantially circular in shape.

Although reflector 60 is shown in detail in the drawings, it is merely representative of reflectors in general, and it is to be understood that there are a variety of reflectors that may be used within this embodiment. Also, annular ring 30 is shown to be connected to flange 66 of the reflector 60, it is to be understood that there are a variety of positions and attachment means known in the art to secure and position annular ring to the reflector.

Figure 4:
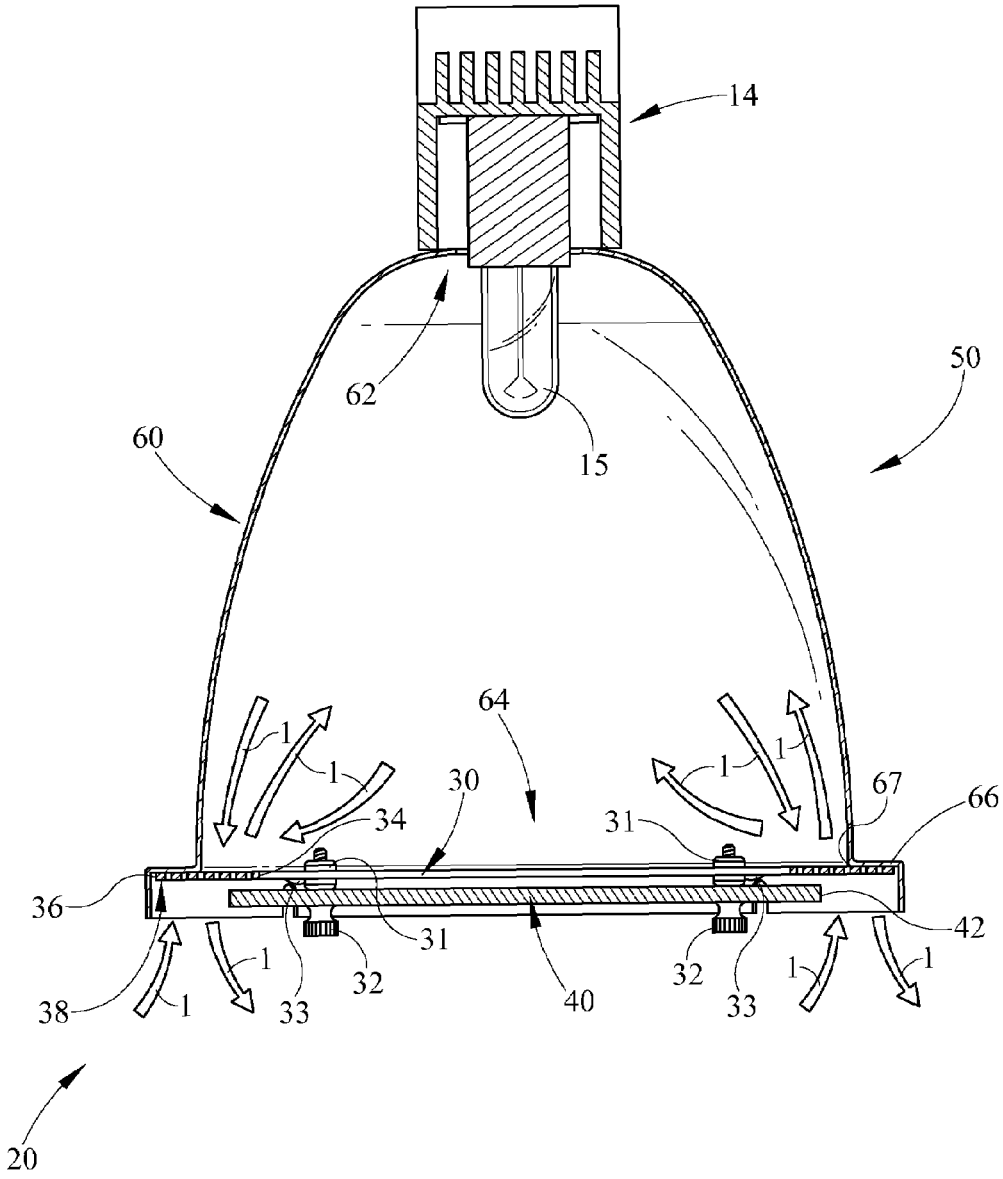
FIG. 4 is a sectional view of the shatter glass guard design of FIG. 3 taken along line 4-4.

The combination of shatter guard lens 40 and annular ring 30 allows for a complete shatter guard enclosure of fixture 50. Shatter guard lens 40 may comprise of a shatter guard material such as, but is not limited to, a polycarbonate. As shown in FIGS. 2-4, lens 40 is attached to an exterior surface 38 of annular ring 30 in the direction away from reflector 60. Lens 40 may be releasably fastened to annular ring 30 by a plurality of grommets 31 inserted into the annular ring whereby a plurality of thumb screws 32 compresses the lens proximately against annular ring. Thumb screws 32 and corresponding grommets 31 delineate the perimeter of a diameter 42 of lens 40, wherein the thumb screws releasably secure the lens in a substantially fixed vertical and horizontal position. Lens 40 may be offset from exterior surface 38 of annular ring 30. Lens 40 may be offset from annular ring 30 because the lens may rest upon grommets 31 as shown in FIG. 4. The offset between annular ring 30 and lens 40 may provide for additional venting of fixture 50. Lens 40 has a smaller diameter 42 than an outer diameter 36 of annular ring 30. However, diameter 42 of lens 40 may be larger than an inner diameter 37 of annular ring 30. Thus, lens 40 is disposed over the opening of inner diameter 37 of annular ring 30. With diameter 42 of lens 40 dimensioned between inner 34 and outer 36 diameter of annular ring 30, a portion of perforations 37 of the annular ring is unencumbered from the lens. The unencumbered perforations 37 between outer diameter 42 of lens 40 and reflector 60 allow for the venting of heat generated within fixture 50 even though the shatter guard lens is placed thereon. FIG. 4 illustrates the circulation of air 1 between the interior and exterior of reflector 60 due to the venting effect. Even though lens 40 is separated from reflector 60, the lens and perforations 37 between an inner diameter 67 of flange 66 and diameter 42 of the lens still provides adequate shatter guard protection.

Annular ring 30 is shown in detail in the drawings, however it should be understood that it may be a variety of different sizes and shapes, and still function to vent air 1 into fixture 50 as shown in FIG. 4, as well as, provide adequate shatter guard protection in combination with lens 40. Annular ring 30 is shown in the drawings as having a continuous engagement between the perimeter of lens 40 and reflector 60. Alternatively, annular ring 30 may be discontinuous and still provide adequate shatter guard protection and venting effect. Also, perforations 37 within annular ring 30 may be a variety of sizes, shapes, quantities, and may be placed in various positions and designs and still function to vent air and prevent shatter glass from passing through. Perforations 37 are detailed in the drawings to substantially encompass the entire annular ring 30. Alternatively, perforations 37 may be discontinuous and still function to provide shatter guard protection and venting effect.

Shatter guard lens 40 illustrated in FIGS. 1-4 is well-known in the art. Although lens 40 is shown in detail in the drawings, it is merely representative of lenses in general, and it is to be understood that there are a variety of lenses which may be used in this embodiment. Also, shatter guard lens 40 is shown to be connected to exterior surface 38 of annular ring 30 by a plurality of thumb screws 32, it is merely representative and it should be understood that there are a variety of attachment means known in the art, both manual and non-manual, to releasably secure the lens to the annular ring.

Shatter glass guard with venting effect design 20 creates convenient maintenance and maximizes the functionality of luminaire 10. By having a reduced diameter shatter guard lens 40, lens 40 and lamp 15 may be installed and removed from fixture 50 after installation into the ceiling without having to gain access from the top of the light housing. Thus, the reduced dimensioned shatter guard lens 40 may be removed from the perforated annular ring 30, by loosening thumb screws 32, and then gaining immediate access to lamp 15 through inner diameter 34 of annular ring 30 for maintenance purposes. The venting effect of lens 40 and annular ring 30 provides for heat generated from lamp 15 to escape or to be circulated out of fixture 50. The cooling of lamp 15 within fixture 50 due to the venting effect of air 1 as shown in FIG. 4 decreases the temperature within the interior of reflector 60 whereby increasing the life expectancy of the lamp. The decreased temperature surrounding lamp 15 also increases the output of the lamp. Shatter guard lens 40 when mounted becomes integral with reflector 60 and moves with the reflector should the reflector need to be adjusted or tilted as necessary for aiming. Also, the use of perforations 37 in the material used for annular ring 30 and the reduced diameter of the shatter guard lens 40 allows significant cost reductions in the amount of material utilized.

It is understood that while certain embodiments of the invention have been illustrated and described, it is not limited thereto except insofar as such limitations are included in the following claims and allowable functional equivalents thereof.

I claim:

1. A shatter glass guard with venting effect comprising:

a reflector having a first opening and a second opening, said first opening is adapted to receive a lamp;

an annular ring disposed over said second opening of said reflector, said annular ring having an outer diameter and an inner diameter, said annular ring having a plurality of perforations, said annular ring having an interior surface facing said reflector and an exterior surface facing away from said reflector, and one or more grommets positioned about said inner diameter of said annular ring;

a circular lens having a diameter within said outer diameter of said annular ring, said lens is disposed over said inner diameter of said annular ring, said lens having an inner surface facing said reflector and an outer surface facing away from said reflector, wherein said inner surface of said lens face towards said exterior surface of said annular ring; and one or more screws extending through said one or more grommets of said annular ring and compressing an outer surface of said lens to maintain said lens position against said one or more grommets creating a vertical gap between said lens and said annular ring to allow airflow into and out of said reflector, said lens is releasably secured against said one or more grommets of said annular ring.

2. The shatter glass guard as in claim 1 wherein said plurality of perforations are substantially circular in shape.

3. The shatter glass guard as in claim 1 wherein said one or more screws are a plurality of thumb screws.

4. The shatter glass guard as in claim 1 wherein at least a portion of said plurality of perforations of said annular ring are located between said reflector and said diameter of said lens.

5. The shatter glass guard as in claim 1 wherein said plurality of perforations being dimensioned to prevent shatter glass from exiting said reflector.

6. The shatter glass guard as in claim 1 wherein at least one of said plurality of perforations of said annular ring positioned axially above said lens and positioned radially within said diameter of said lens.

7. The shatter glass guard as in claim 1 wherein said inner diameter of said annular ring being dimensioned to allow said lamp to pass through.

8. The shatter glass guard as in claim 1 wherein said annular ring is rigidly affixed to said reflector.

9. A light fixture with a shatter glass guard and venting effect design comprising:

a reflector having a first opening and a second opening, said first opening is adapted to receive a lamp, said second opening surrounded by an annular mounting flange;

an annular ring disposed over said second opening and received by said annular mounting flange of said reflector, said annular ring has a inner diameter and an outer diameter, said annular ring has a plurality of perforations, said annular ring having an interior surface facing said reflector and an exterior surface facing away from said reflector, a plurality of grommets projecting from said exterior surface of said annular ring away from said reflector;

a lens having an inner surface facing said reflector and an outer surface facing away from said reflector, wherein said inner surface of said lens face towards said exterior surface of said annular ring, said lens is releasably compressed against an exterior surface of said plurality of grommets maintaining an airflow opening between said inner surface of said lens and said exterior surface of said annular ring, said lens has a diameter smaller than said outer diameter of said annular ring; and said plurality of perforations being dimensioned to prevent shatter glass from exiting through said second opening of said reflector.

10. The light fixture as in claim 9 wherein said plurality of perforations are substantially circular in shape.

11. The light fixture as in claim 9 wherein said plurality of perforations positioned adjacent said inner diameter of said annular ring and extending radially towards said outer diameter of said annular ring, whereby said plurality of perforations axially overlap said lens.

12. The light fixture as in claim 9 wherein at least a portion of said plurality of perforations of said annular ring are located between said reflector and said diameter of said lens.

13. The light fixture as in claim 9 wherein said inner diameter of said annular ring being dimensioned to allow said lamp to pass through.

14. The light fixture as in claim 9 wherein said annular ring is rigidly affixed to said reflector.

15. A luminaire with a shatter glass guard and venting effect design comprising:

a reflector having a first opening and a second opening, said first opening is adapted to receive a lamp;

an annular ring disposed over said second opening of said reflector and rigidly affixed to said reflector, said annular ring having an outer diameter and an inner diameter, said annular ring having a plurality of perforations whereby illumination from said lamp passes through said plurality of perforations away from said luminaire, said annular ring having an interior surface facing said reflector and an exterior surface facing away from said reflector;

a lens having a diameter within said outer diameter of said annular ring, said lens is disposed over said inner diameter of said annular ring, said lens having an inner surface facing said reflector and an outer surface facing away from said reflector, wherein said inner surface of said lens face towards said exterior surface of said annular ring; and said lens is releasably secured to said exterior surface of said annular ring by a plurality of manual fasteners extending through said annular ring and compressing against said outer surface of said lens to maintain said lens axially and radially relative to said annular ring and said lens is removable from said annular ring in a direction facing away from said reflector without disengaging said annular ring from engagement with said reflector.

16. The luminaire as in claim 15 wherein said plurality of perforations are substantially circular in shape.

17. The luminaire as in claim 15 wherein said plurality of manual fasteners comprising of a plurality of thumb screws.

18. The luminaire as in claim 15 wherein at least a portion of said plurality of perforations are radially positioned within said annular ring to overlap said lens.

19. The luminaire as in claim 15 wherein said plurality of perforations being dimensioned to prevent shatter glass from exiting said reflector.

20. The luminaire as in claim 15 wherein an outer annular edge of said lens is vertically offset from said exterior surface of said annular ring in a direction facing away from said reflector creating a vertical opening between said lens and said annular ring permitting airflow to vent into and out of said reflector.

21. The luminaire as in claim 15 wherein said inner diameter of said annular ring being dimensioned to allow said lamp to pass through.

* * * * *

UNITED STATES PATENT AND TRADEMARK OFFICE

CERTIFICATE OF CORRECTION

PATENT NO. : 7,618,168 B1
APPLICATION NO. : 11/555742
DATED : November 17, 2009
INVENTOR(S) : John Jeffrey Buse It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 121 days.

Signed and Sealed this

Nineteenth Day of October, 2010

David J. Kappos

David J. Kappos
*Director of the United States Patent and Trademark Office*